United States Patent [19]

Roe et al.

[11] 4,077,082

[45] Mar. 7, 1978

[54] ROLLER COVER SUPPORT FOR PAINT ROLLER FRAME

[75] Inventors: Elverton O. Roe; Charles Gregg Moore, both of Wooster, Ohio

[73] Assignee: The Wooster Brush Company, Wooster, Ohio

[21] Appl. No.: 687,928

[22] Filed: May 19, 1976

Related U.S. Application Data

[62] Division of Ser. No. 520,666, Nov. 4, 1974, Pat. No. 3,986,226.

[51] Int. Cl.[2] ..... B05C 17/02

[52] U.S. Cl. ..... 15/230.11

[58] Field of Search ..... 15/27, 230.11; 29/110.5; 101/328-331; 401/147, 197, 208, 218-220

[56] References Cited

U.S. PATENT DOCUMENTS

| | | | |
|---|---|---|---|
| 2,654,107 | 10/1953 | Magoon | 15/230.11 X |
| 2,708,763 | 5/1955 | Jacoby | 15/230.11 X |
| 2,823,402 | 2/1958 | Phillips | 15/230.11 X |
| 2,927,334 | 3/1960 | Wonso | 401/197 |
| 3,134,327 | 5/1964 | Sebanc | 401/218 |
| 3,336,625 | 8/1967 | Carlee | 401/197 |
| 3,425,086 | 2/1969 | Ball | 15/230.11 |
| 3,877,123 | 4/1975 | Pharris | 15/230.11 X |
| 3,877,823 | 4/1975 | Leland | 401/197 |

FOREIGN PATENT DOCUMENTS

| | | | |
|---|---|---|---|
| 1,107,072 | 8/1955 | France | 15/230.11 |
| 823,204 | 11/1959 | United Kingdom | 15/230.11 |

*Primary Examiner*—Daniel Blum

*Attorney, Agent, or Firm*—Donnelly, Maky, Renner & Otto

[57] ABSTRACT

Roller cover support consists of blow molded sleeve having plural protruding ribs to frictionally retain the roller cover in place. The ends of the sleeve are molded to receive and mount end caps thereon which include suitable bearings for the roller frame shaft and provide some support against collapse or flattening out of the sleeve during use under pressure. The O.D. of the end caps and adjacent ends of the sleeve are slightly smaller than the I.D. of the roller cover for normal concentricity and guidance of the roller cover onto the sleeve, and the ends of the ribs are tapered to wedge the roller cover on. When the roller frame shaft extends all the way through the roller support, perforations may be placed along the length of the sleeve to provide for drainage of any water or other liquid that may seep into the interior of the sleeve through the end cap bearings during clean up. However, a Y-shape frame may be used having spaced apart end supports for both ends of the sleeve, so that the end caps may be completely closed to keep water out. Such end supports are preferably substantially flat and parallel to each other and relatively thin so as not to interfere with painting closely adjacent to a corner and the like.

9 Claims, 8 Drawing Figures

ROLLER COVER SUPPORT FOR PAINT ROLLER FRAME

BACKGROUND OF THE INVENTION

This is a division of application Ser. No. 520,666, filed Nov. 4, 1974, now U.S. Pat. No. 3,986,226 issued Oct. 19, 1976. This invention relates generally as indicated to a roller cover support for a paint roller frame, and more particularly to such a roller cover support which is relatively inexpensive to manufacture, very lightweight for ease of handling, and permits ready removal and replacement of the paint roller cover after use for easy clean up and reuse.

There are many known types of paint roller frames which provide for replacement of the paint roller cover after use so that the frame may be reused at a substantial savings. The most common way of retaining the paint roller cover on the frame is by a wing nut or the like threaded onto the outboard end of the roller frame shaft. However, to replace the roller cover requires the operator to unscrew the nut and physically pull the cover off the shaft, which is particularly unsatisfactory when the roller cover and other parts of the roller frame are coated with paint. Reinserting the roller frame shaft through the holes in the end caps of a new roller cover is also sometimes difficult and time consuming, and the threaded end of the roller frame shaft usually projects beyond the outboard end of the paint roller cover after assembly by an amount sufficient to interfere with painting closely adjacent to corners and the like.

Flexible metal cage frames are also used for frictionally retaining paint roller covers in place, but they are relatively expensive and difficult to control the amount of force required to assemble and disassemble the roller cover from the cage.

An improved paint roller frame which positively retains the roller cover thereon during use and yet permits ready removal of the roller cover without having to touch it is shown and described in U.S. Pat. No. 3,751,748, granted Aug. 14, 1973. However, there is still a need for a less expensive roller cover support which provides for the ready removal and replacement of the paint roller cover after use for easy clean up and reuse, which is a principal object of the present invention.

Another object is to provide such a roller cover support which is very lightweight for ease of handling.

Another object is to provide such a roller cover support which resists or prevents the intrusion of paint and other materials into the interior thereof, and resists adherence of paint to the exterior thereof.

Yet another object is to provide such a roller cover support which, in one form of the invention, is entirely closed to prevent any water or the like from entering the support and becoming trapped during clean up.

These and other objects of the present invention may be achieved by providing a roller cover support in the form of a blow molded sleeve or spindle having a plurality of protruding ribs thereon to frictionally retain the roller cover in place. The sleeve is preferably made of a high density polyurethane or polypropylene having the desired impact resistance and controlled elasticity or flexibility for firmly gripping the roller cover, and is supported at its ends by individual end caps which include suitable bearing surfaces for journaling of the support on the roller frame shaft. The O.D. of the end caps and adjacent ends of the sleeve are slightly smaller than the I.D. of the roller cover for normal concentricity and guidance of the roller cover onto the sleeve, and the sleeve desirably tapers slightly inwardly adjacent such ends to avoid possible interference with the cover caused by nonuniform molding and the like. The ends of the ribs are also tapered to wedge the roller cover on, and the extent of interference of the ribs and their length as well as their number and location may be readily varied as desired to obtain the desired amount of friction required to retain the roller cover in place and yet permit ready pull-off of the cover for ease of cleaning and replacement as required.

The ends of the sleeve are molded to readily receive and mount the individual end caps thereon which are desirably injection molded to provide suitable bearings for the roller frame shaft and also provide some support against collapse or flattening out of the sleeve during use under pressure.

When the roller cover support is mounted on a conventional wire roller frame of the type including a handle portion and a shaft portion extending at substantially right angles thereto, the roller cover support bearings must have open ends for receipt of the roller frame shaft from one end, which has the disadvantage that water or solvent may enter the ends of the sleeve through the end cap bearings and become trapped therein during clean up. However, perforations may be placed along the length of the spindle to provide drainage of such water or solvent and also increase the flexibility of the sleeve as desired. Alternatively, the frame may be in the shape of a Y including spaced apart end mounts for both ends of the support, in which event the end caps may be completely closed to keep water or solvent out of the interior of the support. Such end mounts are preferably substantially flat and parallel to each other and relatively thin so as not to interfere with painting closely adjacent to a corner and the like.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DESRIPTION OF THE PREFERRED EMBODIMENTS

Figure 1:
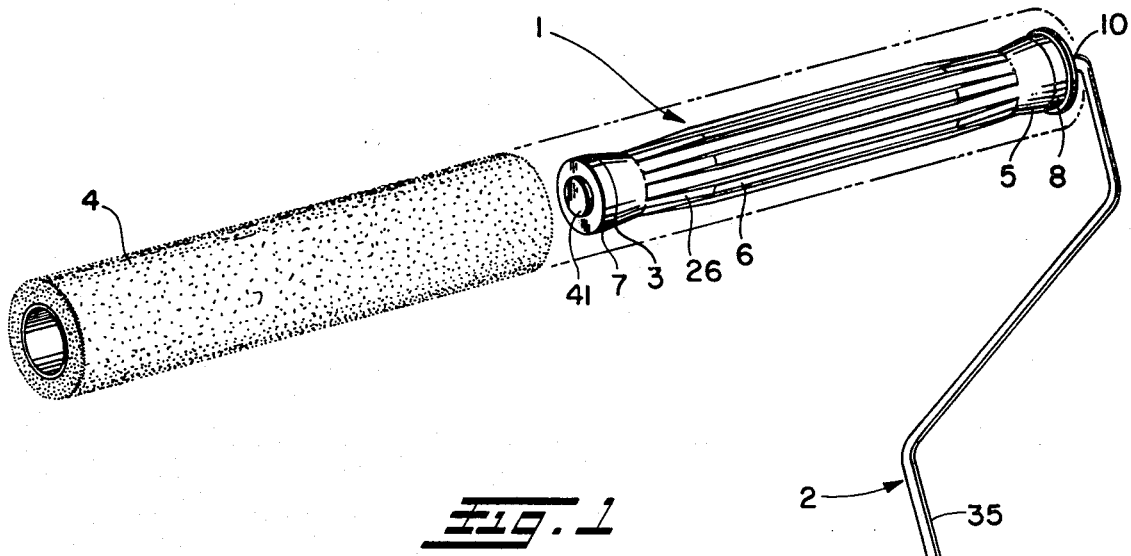
FIG. 1 is an isometric view showing a roller cover support mounted on a conventional wire roller frame.

Referring now in detail to the drawings, and initially to FIG. 1, there is shown by way of example a preferred form of roller cover support 1 in accordance with this invention mounted on a conventional wire roller frame 2. Disposed adjacent the outboard end 3 of the roller cover support 1 is a conventional roller cover 4 which is adapted to be frictionally retained on the roller cover support and yet is readily removable therefrom as desired in a manner to be subsequently fully described.

Figure 2:
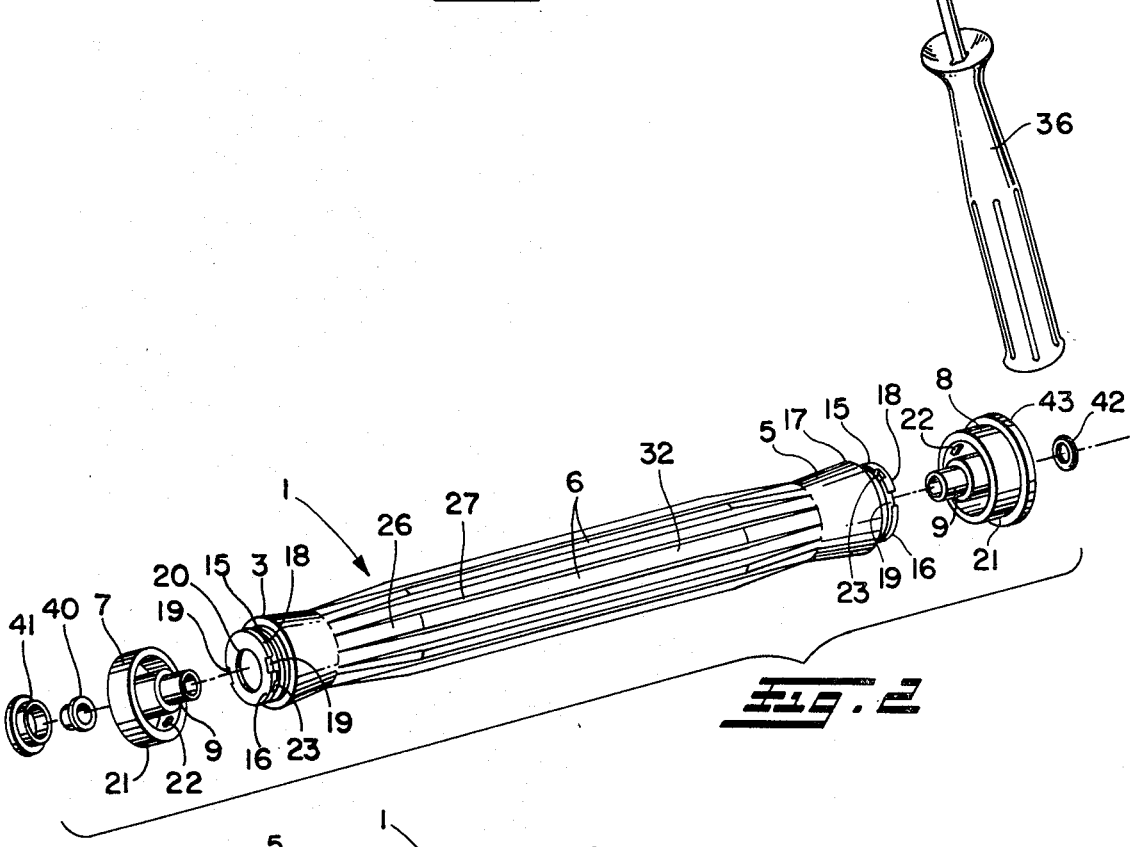
FIG. 2 is an exploded isometric view showing the various parts of the roller cover support of FIG. 1 in disassembled form.
Figure 5:
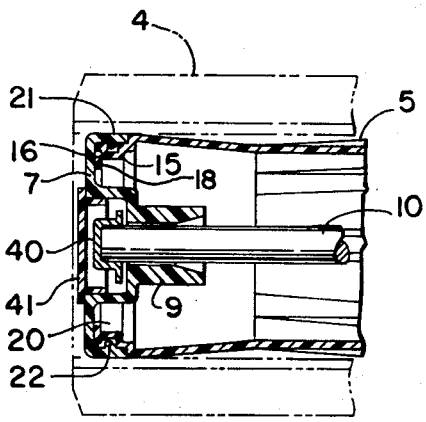
FIG. 5 is an enlarged longitudinal section through the outboard end of the roller cover support of FIG. 1.

As best seen in FIGS. 2 and 5, the roller cover support 1 generally consists of a tubular sleeve or spindle 5 having a plurality of protruding ribs 6 thereon to frictionally retain the roller cover 4 in place and separate, individual end caps 7 and 8 on each end of the sleeve 5 including suitable bearing surfaces 9 for journaling the support 1 on the roller frame shaft 10. By using separate end caps 7 and 8, the sleeve 5 of the roller cover support 1 may be relatively inexpensively blow molded using a suitable high density material such as polyethylene or polypropylene which has the desired impact resistance and controlled elasticity or flexibility for firmly gripping the roller cover.

Heretofore, it was thought impractical to blow mold the sleeve portion 5 because of the inability to form by blow molding suitable end cap bearing structures. However, when the end caps 7 and 8 are formed separately as by injection molding the end caps and the end caps are subsequently mounted on the ends of the sleeve, excellent results are obtained.

During the blow molding process, suitable mounting surfaces 15 may be integrally molded on the ends of the sleeve for attachment of the end caps thereto. In the various forms of the invention shown, protrusions 16 of a reduced diameter are provided on the outboard and inboard ends 3 and 17 of the sleeve, with a flange 18 on the ends of the protrusions which is slotted at diametrically opposite points 19. The end caps 7 and 8 include a central bearing portion 9 of sufficient length and thickness to provide a suitable bearing structure for rotatably mounting the roller cover support 1 on the frame shaft 10 and is adapted to be received within an opening 20 in the ends of the sleeve. An annular hub 21 surrounds the central bearing portion 9 of the end caps and is adapted to extend over the protrusions 16 on the ends of the sleeve upon aligning tabs or projections 22 on the inner surface of the hub 21 with the slots 19 and pushing the end caps axially onto the protrusions so that the tabs 22 are positioned axially inwardly of the flanges 18, whereupon the end caps may be rotated to engage the tabs 22 in grooves or recesses 23 in the back side of the flanges to lock the end caps in place, similar to a bayonet connection. Alternatively, a snap fit may be provided between the end caps 7 and 8 and mounting surfaces 15 of the sleeve, or the end caps may be spin welded or electrosonically welded to the ends of the sleeve as desired.

The O.D. of the annular hub 21 on the end caps 7 and 8 and the adjacent ends 3 and 17 of the sleeve are substantially the same so that there are no protrusions where the two surfaces meet which might interfere with the insertion of the roller cover thereon, and in fact, the outer diameter of these two parts is desirably slightly smaller than the I.D. of the roller cover, for example, 0.005 to 0.025 inch smaller for normal concentricity and guidance of the roller cover onto the sleeve. Adjacent such sleeve ends, the outer surface of the sleeve desirably tapers inwardly from each end to avoid possible interference with the roller cover caused by nonuniform molding of the sleeve adjacent such ends. The ends 26 of the ribs 6 are also desirably tapered outwardly to wedge the roller cover 4 on.

Figure 3:
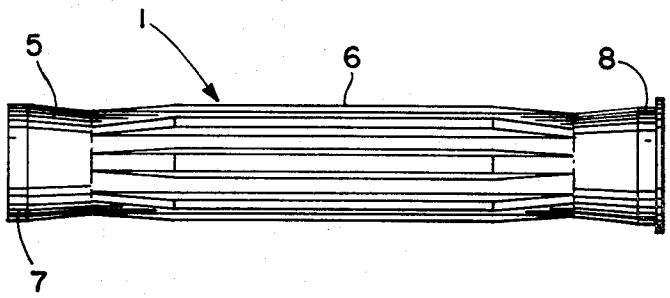
FIG. 3 is a side elevation view of the roller cover support of FIG. 1.

In the preferred form of roller cover support 1 shown in FIGS. 1 through 3, the maximum O.D. of the end caps and sleeve is approximately 1.48 inches and the sleeve tapers inwardly from each end to a minimum O.D. of approximately 1.363 inches over a length of approximately three fourths inch and such minimum O.D. is desirably maintained uniformly over the remaining length of the sleeve inwardly of such tapered ends. Eight ribs are also shown provided on the O.D. of the of the sleeve, with their ends 26 commencing at the minimum diameter approximately three fourths inches from the ends of the sleeve and gradually tapering outwardly to their maximum O.D. of approximately 1.49 inch over a distance of approximately 1 9/16 inches. The width of each rib 6 is approximately 0.187 inch, and the sides or flanks 27 of such ribs are also tapered at an angle of approximately 30°. However, it will be appreciated that the extent of interference of the ribs and their length as well as number and location may readily be varied to obtain the desired amount of friction to retain the roller cover in place during use and still permit the roller cover to be pulled off for cleaning and replacement as required.

Figure 4:
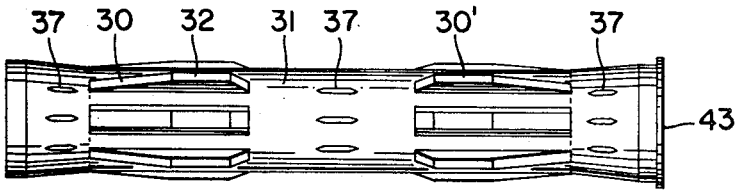
FIG. 4 is a side elevation view similar to FIG. 3 but showing a modified form of roller cover support in accordance with this invention.

In FIG. 4, there is shown two shorter sets of ribs 30, 30′ on the sleeve 31, one set adjacent each end of the sleeve, and it will be apparent that one such set may be eliminated from either end if desired. It will also be apparent that the frictional engaging surfaces 32 of the ribs may be textured to provide a grainy surface for increased friction, which is readily accomplished as by etching the mold in the desired area to obtain the desired texture.

The roller frame 2 for the roller cover support 1 may be of a conventional type such as shown in FIG. 1 made from heavy gauge wire or rod bent to shape to provide a handle portion 35 at one end with a handle grip 36 attached thereto and a shaft portion 10 extending at right angles thereto for extension through the roller cover support 1 from one end. In that event, the bearing portions 9 of the end caps 7 and 8 must have open ends for receipt of the roller frame shaft 10, which has the disadvantage that water or solvent may enter the ends of the roller cover support through the bearing portions and become trapped therein during clean up. However, perforations 37 may be placed along the length of the sleeve 31 as shown in FIG. 4 to provide for drainage of such water or solvent and also increase the flexibility of the sleeve as desired, but of course this requires a secondary operation at additional expense.

The roller cover support 1 is desirably permanently mounted on the shaft portion 10 of the wire roller frame 2 as by placing a snap-on cap 40 on the outboard end of the shaft 10 as shown in FIG. 5, and a separate closure member 41 may be inserted into the center of the outboard end cap 7 to cover the snap-on cap and outboard end of the shaft so as to prevent paint from accumulating therein. Similarly, an annular seal 42 such as shown in FIG. 2 may be placed between the shaft 10 and bearing portion 9 of the inboard end cap 8 to prevent paint from intruding between these latter two surfaces.

To assemble the roller cover 4 onto the roller cover support 1 merely requires the insertion of one end of the roller cover over the outboard end 3 of the roller cover support to concentrically locate the roller cover thereon and then push the roller cover onto the roller cover support causing the roller cover to be cammed against the tapered ribs 6 or 30, 30' and be frictionally engaged thereby. An outer peripheral shoulder or step 43 on the outer end of the inboard end cap 8 serves to accurately locate the roller cover in the desired assembled position on the roller cover support upon engagement by the inboard end of the roller cover.

The amount of friction between the ribs 6 or 30, 31' and roller cover 4 will determine the amount of force required to push the roller cover onto the roller cover support and remove the same therefrom, and such friction may readily be controlled during blow molding of the sleeve by proper selection of the material used for the sleeve and controlling the wall thickness of the sleeve and the maximum diameter, length, and number of the ribs. High density polyethylene or polypropylene is desirably used for the sleeve because its elasticity or flexibility can readily be controlled, and it also has good impact resistance and paint does not readily adhere thereto, which makes for easy clean up. A blow molded sleeve or spindle is also relatively inexpensive and lightweight for ease of handling, and may also be made aesthetically appealing and in different colors for enhanced eye appeal.

The end caps may be made of the same or a different material than the sleeve, and are formed separately as by injection molding so as to be able to obtain the necessary bearing structure for good bearing life and also provide adequate support against collapse or flattening out of the sleeve 5 or 31 during use under pressure.

Figure 7:
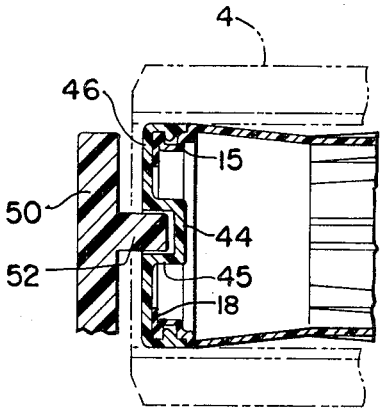
FIG. 7 is an enlarged longitudinal section through the left-most end of the roller cover support of FIG. 6 showing the manner of attachment of the roller cover support to the roller frame.

The problem of water or solvent entering the roller cover support through the end caps and becoming trapped therein during clean up may also be eliminated simply by closing the inner ends 44 of the bearing portions 45 of the end caps 46, 47 as shown in FIG. 7. However, in that event the wire roller frame 2 such as shown in FIG. 1 cannot be used. Instead, a generally Y-shape frame 48 of the type shown in FIG. 6 may be used, including a handle portion 49 and a pair of spaced apart end mounts 50 for both ends of the roller cover support 51. The end mounts 50 of the roller frame 48 are desirably substantially flat and parallel to each other and relatively thin as shown so as not to interfere with painting closely adjacent to a corner and the like, and a stub shaft 52 projects inwardly from each of the end mounts 50 for receipt in the bearing recesses 45 in the end caps 46, 47 as shown in FIG. 7. Alternatively, the stub shafts 53 may be provided on the end caps 54 and suitable openings 55 provided in the end mounts 56 of the roller frame for receipt of the stub shafts as shown in FIG. 8.

Figure 6:
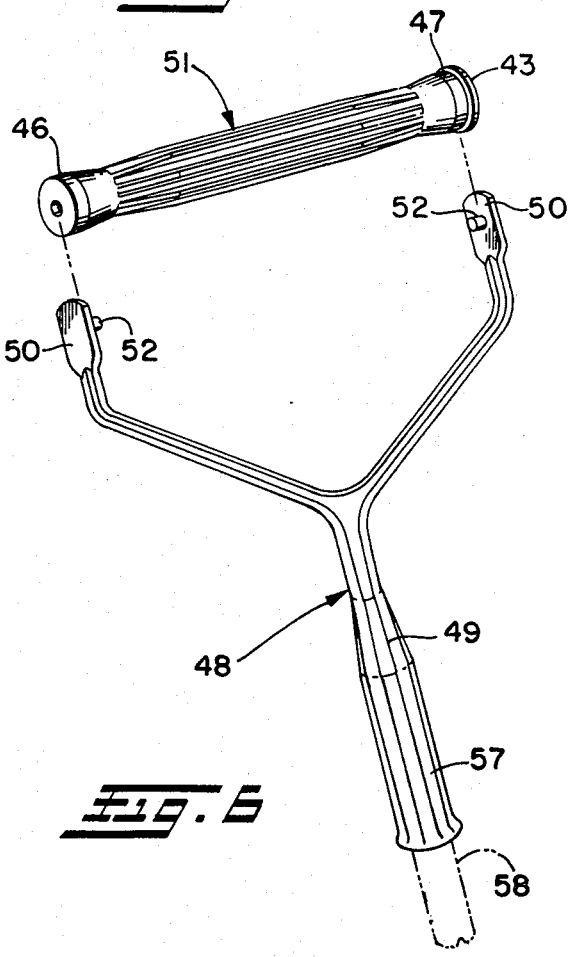
FIG. 6 is an isometric view of another form of roller cover support in accordance with this invention especially suited for mounting within a Y-shape frame of the type also illustrated in FIG. 6.

The entire roller frame shown in FIG. 6, including the handle portion and spaced apart end mounts may be made of a suitable plastic material, and the handle portion 48 may have a larger diameter grip portion 57 integral therewith, including a hollow core end to accept a handle extension 58 is desired. A similar hollow core end may be provided on the handle 36 of the frame 2 shown in FIG. 1 for receipt of a handle extension.

Figure 8:
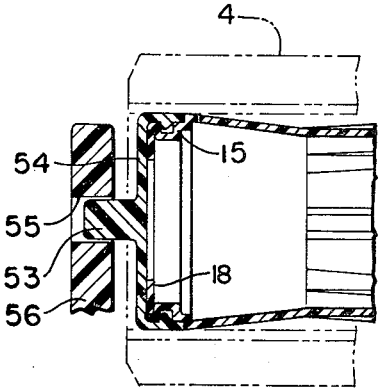
FIG. 8 is a fragmentary longitudinal section similar to FIG. 7 but showing a modified form of mounting for the roller cover support to the roller frame.

To mount a roller cover 4 on the roller cover support 51 when used with a roller frame 48 of the type shown in FIG. 6, the roller cover support must first be removed from the roller frame as by springing or flexing the end mounts 50 apart to free the stub shafts 52 on the end mounts from the bearing recesses 45 in the end caps 46, 47 as shown in FIG. 7 or the stub shafts 53 on the end caps 54 from the openings 55 in the end mounts 56 as shown in FIG. 8. Then, one end of the roller cover 4 may readily be inserted onto the outboard end of the roller cover support 51 and the roller cover may be pushed completely onto the roller cover support until the end engages the shoulder 43 on the inboard end, whereupon the roller cover is firmly frictionally held in place by the protruding ribs in the same manner as previously described. Afterwards, the roller cover support 51 with roller cover mounted thereon may be readily reassembled onto the roller frame 48 by flexing the end mounts 56 apart to bring the stub shafts and bearing surfaces back into alignment with each other as before.

From the foregoing, it will now be apparent that the various roller cover supports of the present invention are relatively inexpensive and yet permit ready removal and replacement of a paint roller cover after use for easy clean up and reuse. The roller cover supports are also very lightweight for ease of handling, and in one form of the invention may be entirely closed to prevent any water or the like from entering the ends of the support and becoming trapped during clean up.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

The embodiments of the invention in which an exclusive property or privilege is claimed are defined as follows:

1. A roller cover support and paint roller frame comprising a plastic molded sleeve having means thereon for frictionally retaining a roller cover on such sleeve, separately formed end caps secured to the ends of said sleeve, said end caps having bearings for journaling of said roller cover support on said paint roller frame, said paint roller frame comprising a handle portion and a pair of spaced apart end mounts for receipt of said roller cover support therebetween, one of said end mounts and bearings having stub shafts thereon for receipt in openings in the other of said end mounts and bearings, said sleeve being blow molded as a single piece from a high density plastic material having high impact resistance and controlled flexibility for firmly gripping the roller cover and controlling the amount of pull off required to remove the roller cover from said support for ease of cleaning and replacement, said end caps being injection molded to form said bearings for rotatably mounting said roller cover support on said paint roller frame and support said sleeve against collapse or flattening out during use under pressure, said ends of said sleeve having integrally blow molded protrusions thereon of reduced diameter, said protrusions having outer faces in the form of flanges with central openings in said flanges said end caps having annular hub portions which extend over said reduced diameter protrusions on said sleeve ends, said hub portions contacting said sleeve ends and being of the same O.D. as said sleeve ends adjacent said protrusions.

2. The roller cover support and paint roller frame of claim 1 wherein said stub shafts are on said end mounts, said first mentioned openings being in said bearings for receipt of said stub shafts and said central openings receiving said bearings.

3. The roller cover support and paint roller frame of claim 2 wherein said bearings are closed at their inner ends to prevent water or solvent from entering the interior of said sleeve during clean up.

4. The roller cover support and paint roller frame of claim 1 wherein said end caps are closed and said stub shafts project outwardly therefrom, and said first mentioned openings being in said end mounts for receipt of said stub shafts.

5. The roller cover support and paint roller frame of claim 1 wherein said end mounts are substantially flat and parallel to each other and relatively thin so as not to interfere with painting closely adjacent to a corner and the like.

6. The roller cover support and paint roller frame of claim 1 wherein said sleeve tapers slightly inwardly adjacent said sleeve ends slightly inwardly spaced from the inner ends of said end caps.

7. The roller cover support and paint roller frame of claim 1 wherein said paint roller frame is generally Y-shape except for said end mounts which are substantially flat and parallel to each other and relatively thin so as not to interfere with painting closely adjacent to a corner and the like.

8. A roller cover support and paint roller frame comprising a plastic molded sleeve having means thereon for frictionally retaining a roller cover on such sleeve, separately formed end caps secured to the ends of said sleeve, said end caps having bearings for journaling of said roller cover support on said paint roller frame, said paint roller frame comprising a handle portion and a pair of spaced apart end mounts for receipt of said roller cover support therebetween, one of said end mounts and bearings having stub shafts thereon for receipt in openings in the other of said end mounts and bearings, said means for frictionally retaining the roller cover on said sleeve comprising a plurality of protruding ribs on said plastic molded sleeve, said sleeve, including said ribs, being blow molded as a single piece from a high density plastic material having high impact resistance and controlled flexibility for firmly gripping the roller cover and controlling the amount of pull off required to remove the roller cover from said support for ease of cleaning and replacement, the ends of said ribs being tapered to wedge the roller cover on said sleeve, there being two separate sets of said ribs, one of said sets being located adjacent each end of said sleeve.

9. A roller cover support and paint roller frame comprising a plastic molded sleeve having means thereon for frictionally retaining a roller cover on such sleeve, separately formed end caps secured to the ends of said sleeve, said end caps having bearings for journaling of said roller cover support on said paint roller frame, said paint roller frame comprising a handle portion and a pair of spaced apart end mounts for receipt of said roller cover support therebetween, one of said end mounts and bearings having stub shafts thereon for receipt in openings in the other of said end mounts and bearings, said means for frictionally retaining the roller cover on said sleeve comprising a plurality of protruding ribs on said plastic molded sleeve, said sleeve, including said ribs, being blow molded as a single piece from a high density plastic material having high impact resistance and controlled flexibility for firmly gripping the roller cover and controlling the amount of pull off required to remove the roller cover from said support for ease of cleaning and replacement, the ends of said ribs being tapered to wedge the roller cover on said sleeve, said end caps being injection molded to form said bearings for rotatably mounting said roller cover support on said paint roller frame and support said sleeve against collapse or flattening out during use under pressure, said ends of said sleeve having integrally blow molded protrusions thereon of reduced diameter, with central openings in said protrusions for receipt of said bearings on said end caps, said end caps having annular hub portions surrounding said bearings which extend over said reduced diameter protrusions on said sleeve ends, said hub portions contacting said sleeve ends and being of the same O.D. as said sleeve ends adjacent said protrusions.

* * * * *